US007384013B2

(12) United States Patent
Yen

(10) Patent No.: US 7,384,013 B2
(45) Date of Patent: Jun. 10, 2008

(54) CORD RETRIEVER

(76) Inventor: Hsu-Li Yen, 3F-2, No. 13, Wu Chuan 1 Rd., Hsin Chuang City, Taipei Hsien (TW)

( * ) Notice: Subject to any disclaimer, the term of this patent is extended or adjusted under 35 U.S.C. 154(b) by 327 days.

(21) Appl. No.: 11/348,258

(22) Filed: Feb. 7, 2006

(65) Prior Publication Data

US 2007/0181730 A1 Aug. 9, 2007

(51) Int. Cl.
*B65H 75/48* (2006.01)

(52) U.S. Cl. ..... 242/378; 242/378.1; 242/378.2; 242/378.3

(58) Field of Classification Search ..... 242/378, 242/378.1–378.4, 422.4
See application file for complete search history.

(56) References Cited

U.S. PATENT DOCUMENTS

| | | | | |
|---|---|---|---|---|
| 7,222,811 | B2 * | 5/2007 | Chang | 242/378.1 |
| 7,222,812 | B2 * | 5/2007 | Chang et al. | 242/378.1 |
| 2006/0011763 | A1 * | 1/2006 | Kuo | 242/378.1 |
| 2007/0001046 | A1 * | 1/2007 | Wu | 242/378.1 |

* cited by examiner

*Primary Examiner*—Peter M. Cuomo
*Assistant Examiner*—Sang Kim
(74) *Attorney, Agent, or Firm*—Rosenberg, Klein & Lee

(57) ABSTRACT

A structural innovation of cord retriever, a structural design for multiple-step control of pulling length of a cord, to achieve the purpose of making adjustment of a cord length as required by the user and fast and smooth retrieving thereof.

2 Claims, 5 Drawing Sheets

CORD RETRIEVER

BACKGROUND OF THE INVENTION

1. Field of the Invention

The present invention relates to a structural innovation of a cord retriever, a structural design for multiple-step control of pulling a length of a cord, applicable to winding and retrieving control of cords in various electronic products, and computer and communication appliances.

2. Description of the Related Art

With the advancement of modern-day technology, the structures of computer, electric appliances, and communication equipment have been seeking improvement to satisfy market demand. Among them, the retrieval of cords in various appliances has always causes trouble to most users. To address that shortcoming, manufacturers have designed various types of cord retrieving devices for the purpose of retrieving cords and controlling the length of use of cords.

With the abovementioned cord retrievers, two ends of the cord are pulled out directly by hand for ready use. But the length so pulled is only in one step. In other words, the entire length of the cord shall be pulled out completely before the pulled length is fixed for use. To retrieve the cord, the user has to pull on two ends of the cord before releasing it, and then the cord will be automatically retrieved. However, its retrieving force would be too powerful, and the end of the cord would swing violently because of too fast cord retrieving speed, which may cause injury to the user's hand.

There is another type of cord retriever designed in multiple steps of pulled cord length. Though that design enables multiple steps of cord length to be stopped, but it is unable to stop the cord at a length required by the user, nor will it make fine adjustment of the length. Furthermore, the pulling operation in cord retrieving process is more sophisticated and unsure, so it requires multiple pulling operations to completely retrieve the cord.

To seek possible solution to the above shortcoming, the present inventor has been dedicated to repeated experiments and research and has finally come up with the present invention with its sophisticated structural design to enhance better convenience and applicability of cord retriever.

For better understanding of the structure, performance, objectives, approach and spirit of the present invention, please refer to the following drawings and detailed description of preferred embodiment.

SUMMARY OF THE INVENTION

The present invention is a structural innovation of a cord retriever, a structural design for multiple-step control of pulling length of a cord, to achieve the purpose of making adjustment of a cord length as required by the user and smooth retrieving thereof.

FIG. 1 is an exploded view of the cord retriever in the invention. As shown, the cord retriever comprises: a casing 20, having at a middle part thereof a recessed part 201*a* and a recessed track 201*b*; a mobile top unit 30, having a recessed opening 30*a* at one end thereof and a jutted unit 30*b* at another end thereof; a bow-like spring unit 40; a shaft unit 50, having a carrier plate 501 with a round recessed part 501*a*, a shaft post 501*b* at a center thereof, and a track hole 502 at a lower part of the shaft post 501*b*; a turning disc 60, its outer margin having a plurality of sectioned openings to accommodate insertion by a cord unit 70, its center having a spring groove 601 and a shaft hole 601*a* to accommodate insertion by a winding spring 8, having a mobile track groove 602 on the bottom side of the turning disc 60, with an insertion of a partitioning ring plate 603, wherein the cord unit is wound on the outside margin of the turning disc 60; and an upper cover 10.

Wherein (referring to FIGS. 2 and 3) the mobile track groove 602 on the bottom of the turning disc 60 has an inside track groove 602*a*. One side of the inside track groove 602*a* has a positioning track groove 602*b*, another side thereof has an outlet 602*c* communicating with an outside ring track 602*d*. Provided near the outlet 602*c* is a movable inside shifting arm 80 and an outside shifting arm 81, the inside shifting arm 80 being pressed against the inside track groove 602*a*, and the outside shifting arm being pressed against the outlet 602*c*, the inside shifting arm 80 and the outside shifting arm 81 being in the shape of a flexible arched arm.

Referring to FIGS. 1, 2 and 3, the recessed part 201*a* of the casing 20 and a recessed track 201*b* are respectively accommodated in a mobile top unit 30 and a bow-like spring unit 40, wherein, the spring unit 40 is pressing against a side of the recessed part 201*a* of the casing 20. The middle part of the spring unit 40 is hooked to the recessed opening 30*a* of the mobile top unit 30, and further fastened thereon by a shaft unit 50. The track hole 502 at a lower part of the shaft post 501*b* provides a space for reciprocal movement of the jutted unit 30*b* of the mobile top unit 30. Then, a shaft hole 61*a* of the turning disc 60 inserted with the cord unit 70 is inserted with the shaft post 501*b* of the shaft unit 50, and the winding spring 8 is inserted in the spring groove 601 of the turning disc 60. The middle end of the winding spring 8 is inserted in the shaft post 501*b* of the shaft unit 50. The end of the winding spring 8 is inserted to the turning disc 60, and then the upper cover 10 is covered to form a cord retriever.

As shown in FIG. 4, the mobile top unit 30 moves between the recessed track 201*b* of the casing 20 and the shaft hole 502 of a carrier plate 501. Movement of the mobile top unit 30 is activated by rotating and pressing force from the mobile track groove 602 of the turning disc 60 or from a flexible anti-tension from the spring unit 40.

DETAILED DESCRIPTION OF THE INVENTION

Figure 1:
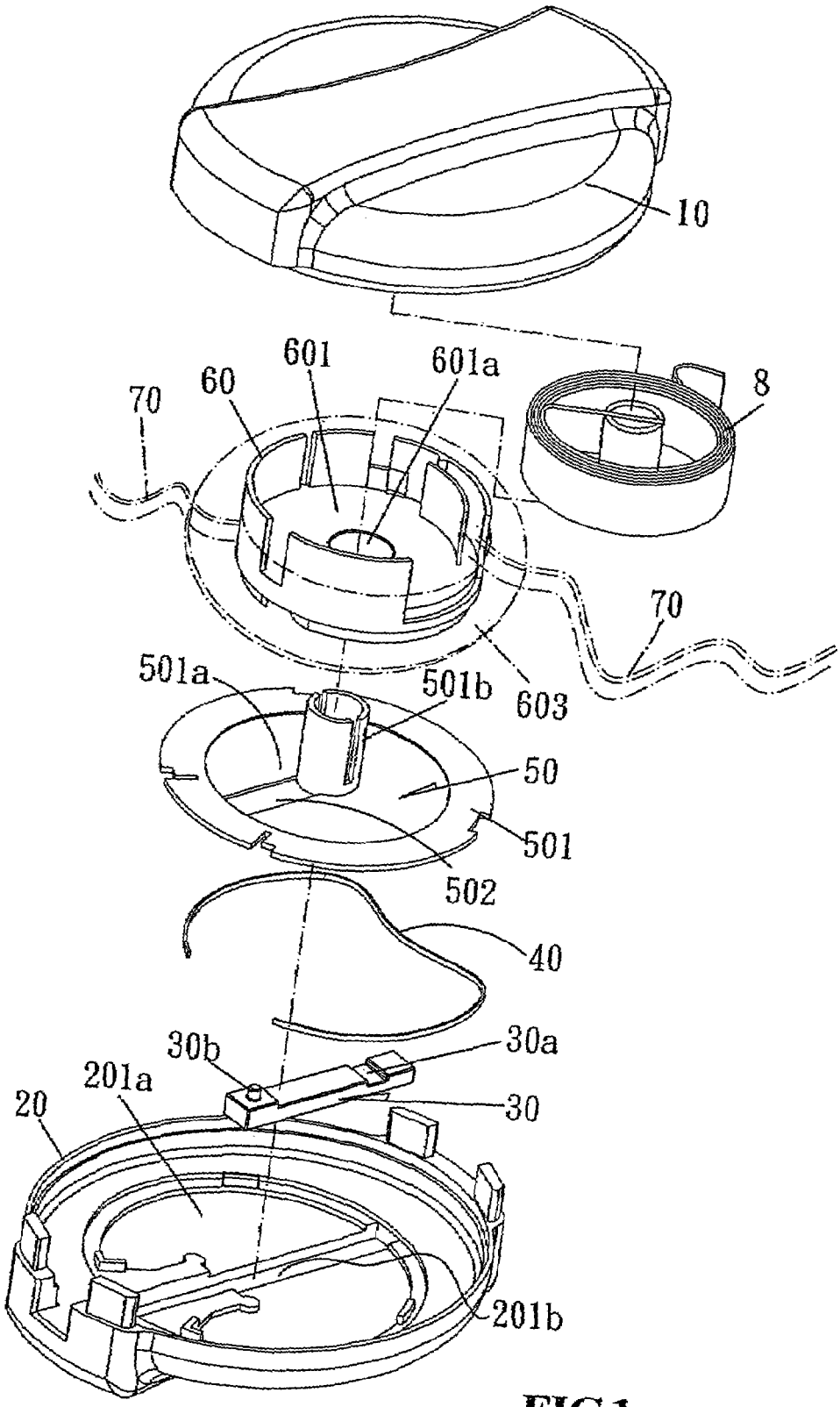
FIG. 1 is an exploded view of the cord retriever in the present invention.
Figure 2:
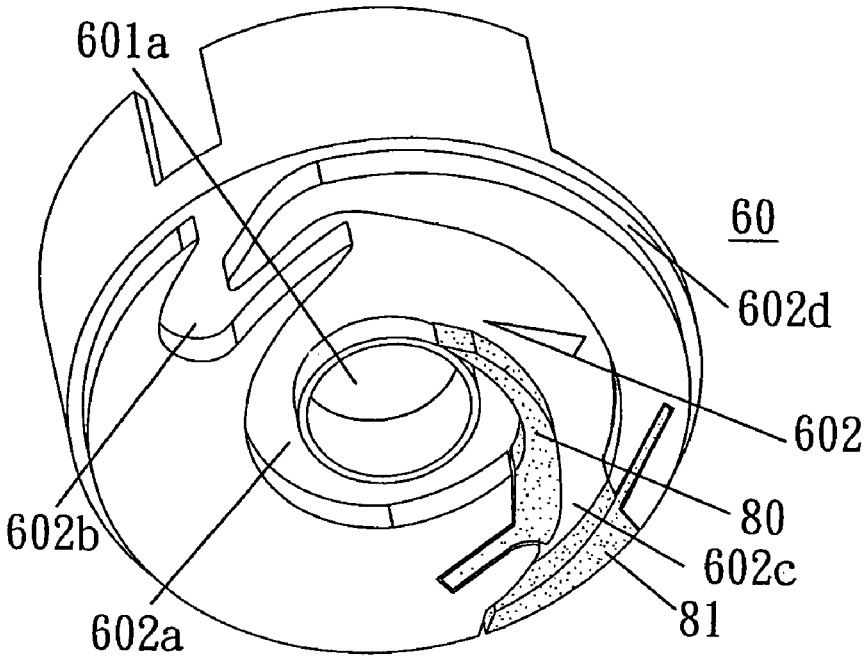
FIG. 2 is a perspective view of the bottom of turning disc in the invention.
Figure 3:
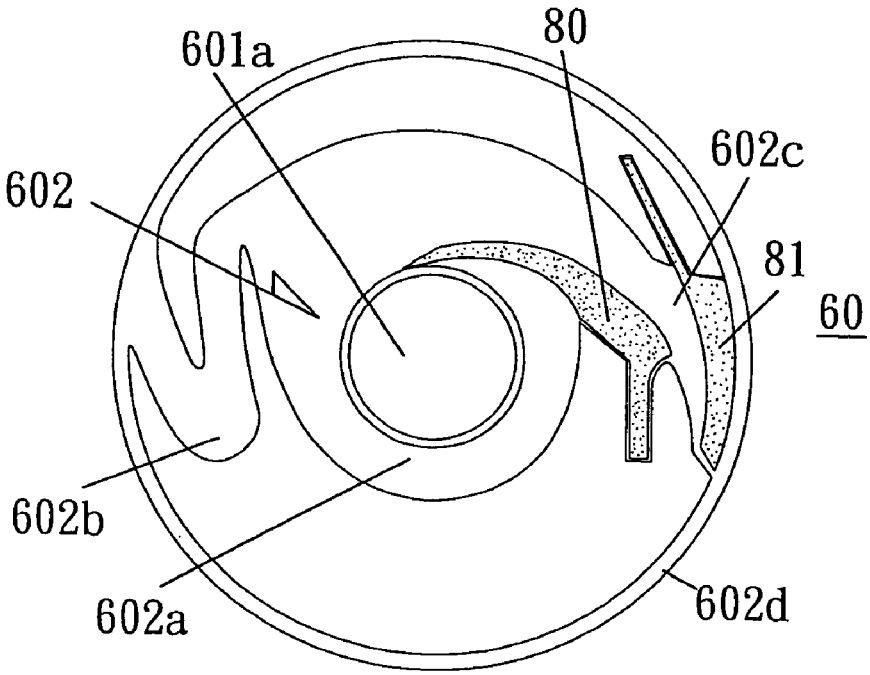
FIG. 3 is a schematic view of the mobile track on the bottom of turning disc in the invention.
Figure 4:
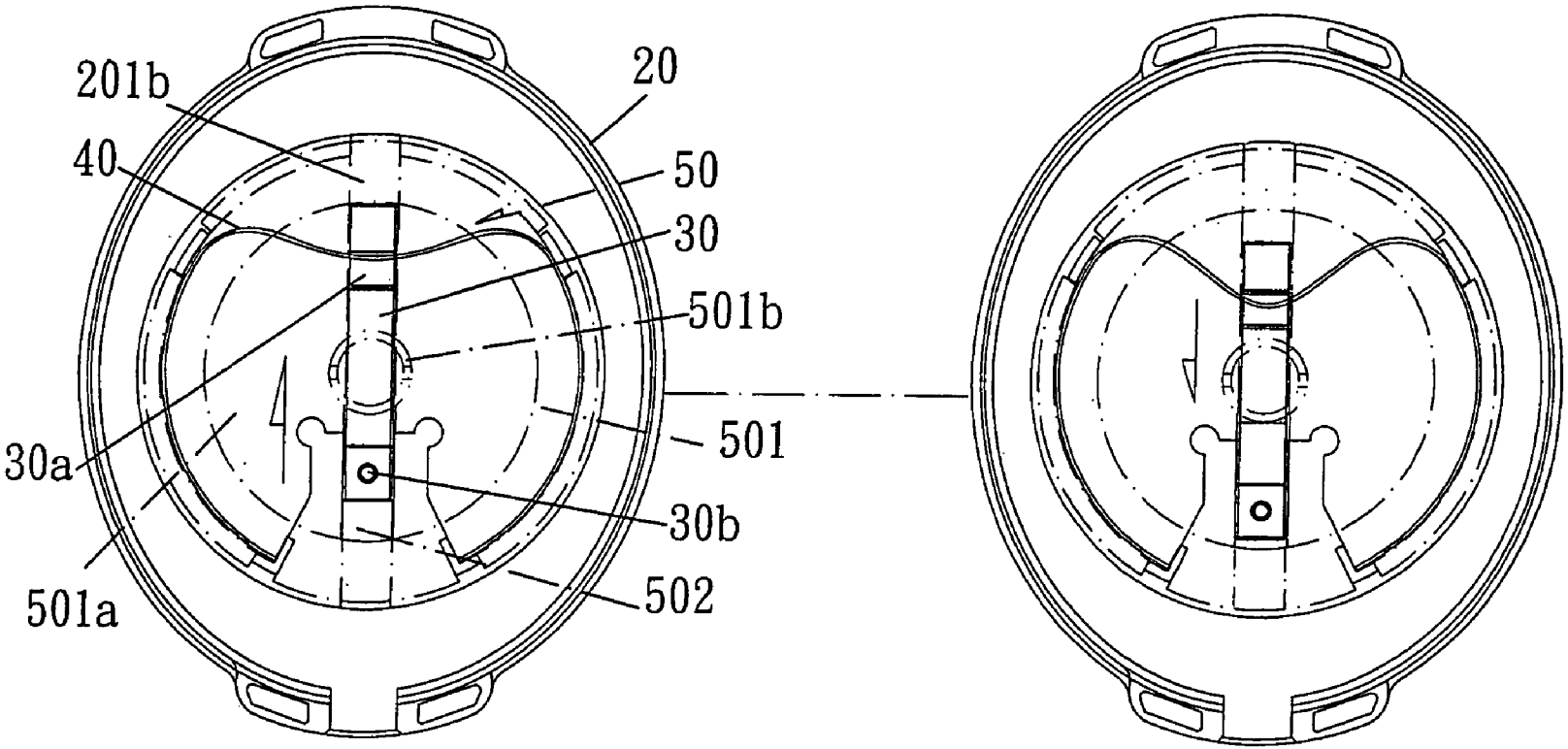
FIG. 4 shows how the mobile top unit of the invention moves between the recessed track and the track hole on the bottom disc.
Figure 5:
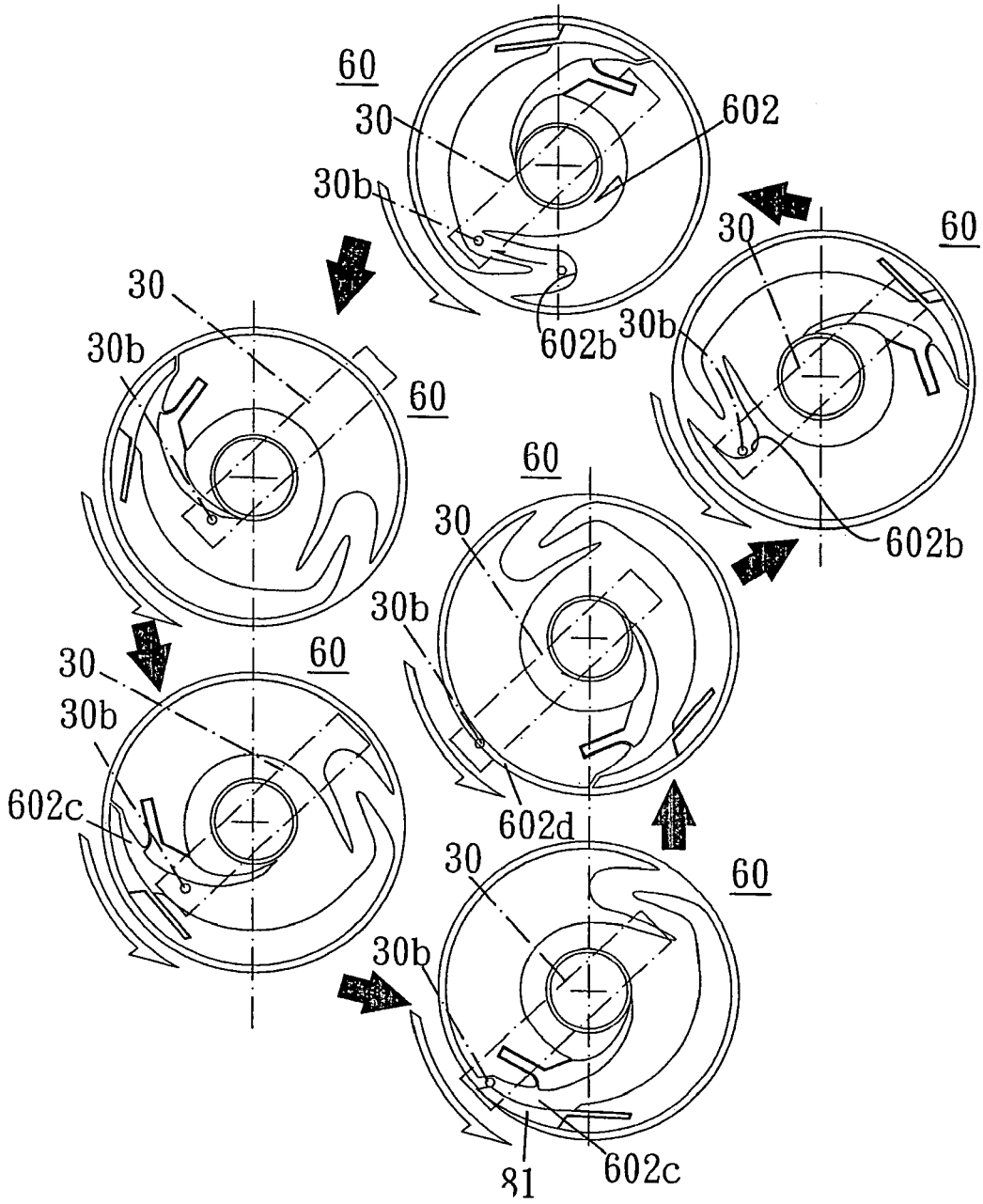
FIG. 5 shows how the mobile top unit of the invention moves in the recessed track on the bottom of turning disc when the cord unit is pulled out of the cord retriever in the invention.

As shown in FIG. 5, manual pulling (referring also to FIG. 1) of the cord unit 70 from two sides of the cord retriever will drive the turning disc 60 to rotate, while the jutted unit 30*b* of the mobile top unit 30 of the mobile track groove 602 on bottom side of the turning disc 60 is rotated and pressed by the mobile track groove 602 out of the outlet 602*c*, pushing the outside shifting arm 81 to form an opening and enters the outside ring track 602*d*, then it is positioned by the positioning track groove 602*b*, to pull out a stretch of cord unit 70 for use, wherein, the jutted unit 30*b* of the mobile top unit 30 is located in the positioning track groove 602*b* to prevent retrieving of the cord unit 70 by an anti-tension force of the winding spring 8 inside the spring groove 601 of the turning disc 60 driving the turning disc 60 to rotate. After repeating the above, the user can pull out a required length of the cord unit 70 in multiple steps.

Figure 6:
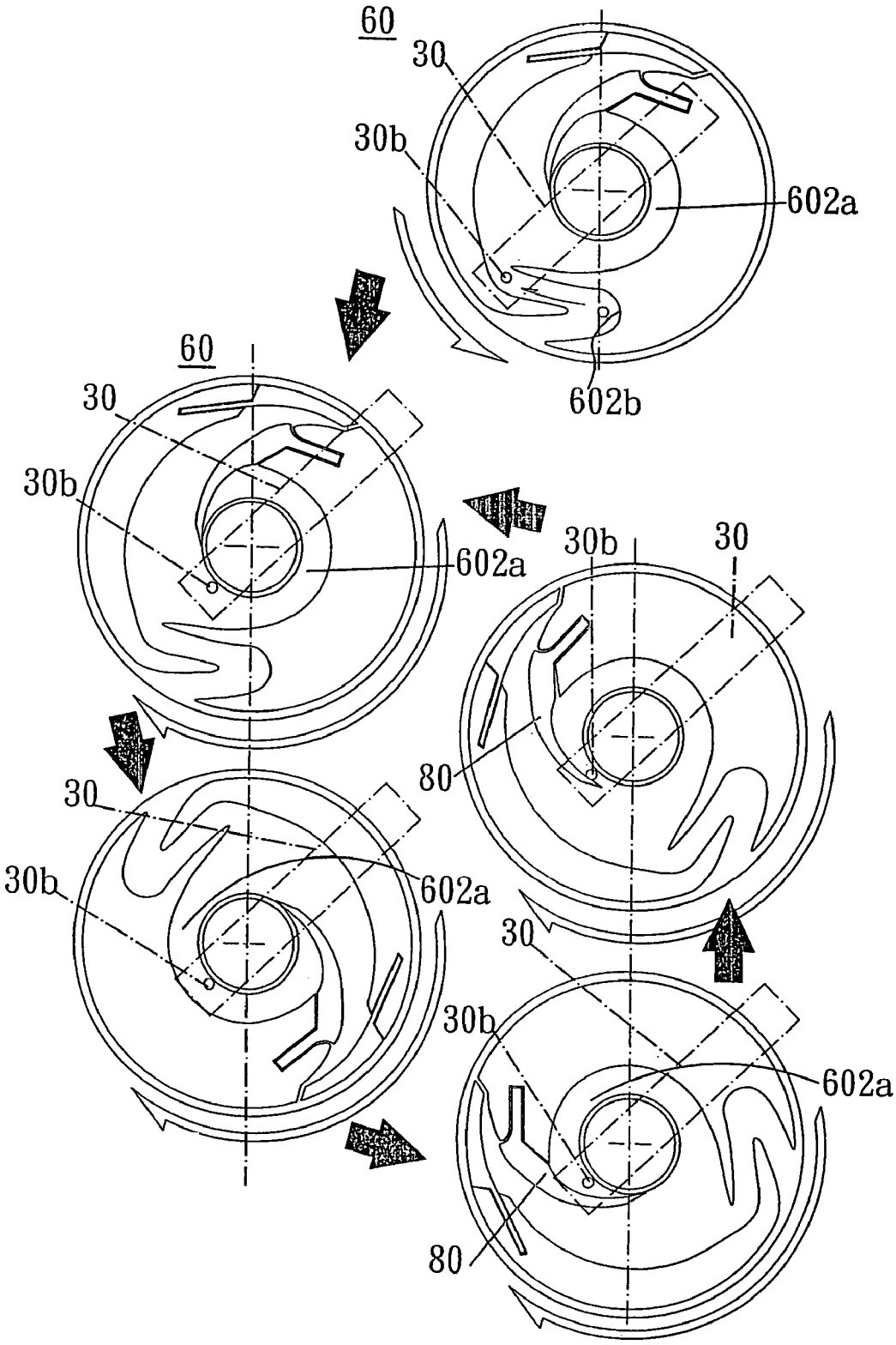
FIG. 6 shows how the mobile top unit of the invention moves in the recessed track on the bottom of turning disc when the cord unit is pulled back into the cord retriever in the invention.

As shown in FIG. 6, the user can retrieve the cord unit 70 into the cord retriever by slightly pulling the cord unit 70 outward to drive the turning disc 60, when the jutted unit 30*b* of the mobile top unit 30 will escape the positioning track groove 602*b* and enters the inside track grove 602*a*. At this stage, the user releases the cord unit 70 (referring to FIG. 1), so the turning disc 60 is forced by the anti-tension force of the winding spring 8 inside thereof to continue pulling back the cord unit 70. The jutted unit 30*b* of the mobile top unit 30 then moves to the inner track groove 602*a* and continues to press on the inside shifting arm 80 to form and push through an opening, thereby forming a slight obstruction to prevent high cord retrieving speed that results in uncontrollable slashing of the cord unit 70 and injury to the user's hand.

As described above, the present invention is capable of achieving the anticipated objectives, and the structure disclosed in the present invention has not yet been used in public. Having satisfied the requirements of applicability and novelty, this application is duly filed.

Various modifications and alterations of this invention will be apparent to those skilled in the art without departing from the scope and spirit of this invention. It should be understood that this invention is not limited to the illustrative embodiments set forth above.

What is claimed is:

1. A structural innovation of cord retriever, comprising: a casing, having a recessed part and a recessed track at a middle part thereof; a mobile top unit, having a recessed opening at one end thereof and a jutted unit at another end thereof; a bow-like spring unit; a shaft unit, having a carrier plate, a round recessed part, a shaft post at a center thereof, and a track hole at a lower part of the shaft post; a turning disc, having a plurality of sectioned openings at a margin thereof to accommodate insertion by a cord unit, a spring groove and a shaft hole at a center thereof to accommodate insertion by a winding spring, having a mobile track groove at a bottom side of the turning disc, inserted by a partitioning ring plate, wherein the cord unit is wound on the outside of the turning disc and an upper cover;

wherein the mobile track groove on the bottom of the turning disc having an inside track groove at a middle part thereof, one side of the inside track groove having a positioning track groove, another side thereof having an outlet and an outside ring track communicating with each other, and, provided near the outlet being a movable inside shifting arm and an outside shifting arm, wherein, the inside shifting arm is pressed against the inside track groove, the outside shifting arm pressed against the outlet; and, the inside shifting arm and the outside shifting arm being in the shape of a flexible arched arm;

thereby the recessed part and the recessed track of the casing accommodate respectively said mobile top unit and a bow-like spring unit; wherein, the spring unit is pressed against a margin of the recessed part of the casing, and a middle part of the spring unit being hooked to the recessed opening of the mobile top unit, then fastened by said shaft unit, the track hole at a lower part of the shaft post providing space for reciprocal movement of the jutted unit of the mobile top unit, then the shaft hole of the turning disc inserted by the cord unit is inserted by the shaft post of the shaft unit, and said winding spring is inserted in the spring groove of the turning disc, a starting end at the middle of the winding spring is inserted in the shaft post of the shaft unit, another end of the winding spring is inserted in the turning disc, and then, the upper cover is covered to form a cord retriever.

2. The structural innovation of cord retriever of claim 1, wherein the mobile top unit moves between the recessed track of the casing and the shaft hole of the carrier plate, movement of the mobile top unit being activated by the jutted unit being pressed by the rotating mobile track groove of the turning disc or a flexible anti-tension force from the spring unit.

* * * * *